US008794712B2

(12) United States Patent
MacNeil et al.

(10) Patent No.: US 8,794,712 B2
(45) Date of Patent: Aug. 5, 2014

(54) REFRACTORY MATERIAL REMOVAL SYSTEM AND METHOD

(76) Inventors: Gerard J. MacNeil, Surrey (CA); David B. MacNeil, Surrey (CA)

( * ) Notice: Subject to any disclaimer, the term of this patent is extended or adjusted under 35 U.S.C. 154(b) by 112 days.

(21) Appl. No.: 13/273,082

(22) Filed: Oct. 13, 2011

(65) Prior Publication Data

US 2012/0103153 A1 May 3, 2012

Related U.S. Application Data

(60) Provisional application No. 61/392,849, filed on Oct. 13, 2010.

(51) Int. Cl.
*E04G 23/08* (2006.01)

(52) U.S. Cl.
USPC ..... 299/17

(58) Field of Classification Search
USPC ..... 299/17
See application file for complete search history.

(56) References Cited

U.S. PATENT DOCUMENTS 5,096,262 A * 3/1992 Foullois ..... 299/55

FOREIGN PATENT DOCUMENTS

JP 2006083600 A * 3/2006
JP 2007308960 A * 11/2007
JP 2009097208 A * 5/2009

* cited by examiner

*Primary Examiner* — John Kreck
(74) *Attorney, Agent, or Firm* — Smiths IP

(57) ABSTRACT

Apparatus for removing refractory lining the inside of a cylindrical structure comprising a traveler received within the structure and movable along its length and having a securing means, a rotatable nozzle assembly connected to the traveler, the nozzle assembly comprising one or more nozzle lines each terminating in a nozzle head that rotates, the nozzle assembly being configured in a manner that each nozzle head is suitably spaced from the refractory to be able to deliver a jet of fluid under pressure to the refractory, a nozzle rotation means for rotating the nozzle assembly, and a conduit means in fluid communication with the nozzle assembly suitable for delivering a flow of fluid to the nozzle assembly under sufficient pressure to cut the refractory material lining the structure. A method employing the apparatus for removing refractory.

1 Claim, 3 Drawing Sheets

REFRACTORY MATERIAL REMOVAL SYSTEM AND METHOD

RELATED APPLICATION

Pursuant to 35 U.S.C. §119, we claim priority benefit of U.S. Provisional Patent Application No. 61/392,849.

BACKGROUND OF THE INVENTION

1. Field of the Invention

The field of the invention is hydro-demolition devices and methods for removing refractory from refractory-lined structures.

2. Description of Related Art

Hydro-demolition—or hydraulic demolition—is a well known art practiced by forcing an erosive material, generally a liquid such as water, through nozzles at sufficiently high pressure to produce a jet stream that disintegrates the constituent building material, normally concrete, of which buildings and structures are made.

The term "refractory" as used herein refers to heat resistant material.

The term "refractory-lined structure" or "RLS" refers to a pipe, riser, cyclone, boiler, kiln, oven, or other structure having an inner lining made of refractory.

The terms "cut," "cutting," and "cutter," etc. as used herein refer to the use of hydro-demolition technology to remove refractory from an RLS.

The use of refractory to line conduits, risers, boilers, cyclones, kilns, and the like is a well known art and essential in many industries. For instance, in the art of fluid catalytic conversion (FCC) of hydrocarbons to produce petroleum products, refractory protects the walls of reactor risers from the extreme temperatures required to crack the hydrocarbon feedstocks.

Because refractory cokes, the working life-time of refractory is limited. Once coking becomes severe it is necessary to remove the coked refractory and replace it with fresh material. Failure to do so results in poor riser hydrodynamics, which causes sub-optimal, inadequate fuel and catalyst mixing. The ultimate result is decreased hydrocarbon conversion and product yield, which increases the price of the petroleum products to consumers.

Currently, removing coked refractory from RLS's is an arduous and expensive process for it must be done manually. The material is chipped away by hammers and chisels. For instance, it may take as many as twenty shifts in order to remove coked refractory from a refinery riser. Given that such a refinery may be producing millions of dollars of product per day, the costs of down time for refractory removal also adds significantly to the cost of petroleum products. Consequently, a system and a method are needed to more quickly and efficiently remove refractory from RLS's.

The present invention is such a system and method that employs hydro-demolition techniques and novel equipment in order to exploit the power of hydro-demolition.

SUMMARY OF THE INVENTION

In order to address some of the shortcomings in the prior art, some aspects of the present invention provide an apparatus for the removal of refractory material lining the inside surface of a cylindrical structure, the apparatus comprising: a traveler adapted to being received within the structure and being moved along the length of the structure, the traveler including a securing means that secures the traveler within the structure in a manner that allows the traveler to be intentionally moved by an operator; a rotatable nozzle assembly defining an axis of rotation and being connected to the traveler, the nozzle assembly comprising one or more nozzle lines each terminating in a nozzle head that rotates about the axis of rotation, the nozzle assembly being configured in a manner that each nozzle head is suitably spaced from the refractory to be able to deliver a jet of fluid under pressure to the refractory; a nozzle rotation means for rotating the nozzle assembly; and a conduit means in fluid communication with the nozzle assembly suitable for delivering a flow of fluid to the nozzle assembly under sufficient pressure to cut the refractory material lining the structure.

In some embodiments, the nozzle assembly may be connected to the traveler in a manner that the axis of rotation of the nozzle assembly is approximately coincident with a central axis defined by the structure.

In some embodiments, the securing assembly may comprise one or more engagement members for contacting the inside surface of the structure or the refractory material, and an extension means cooperating with each engagement member to provide a biasing force to the engagement member towards such contact.

In some embodiments, the traveler may comprise a frame having at least three engagement members radiating outward from the frame in a manner to position the frame centrally within the structure, and the nozzle assembly being connected to the frame in a manner that the axis of rotation of the nozzle assembly is approximately coincident with the central axis defined by the structure.

In some embodiments, each engagement member may comprise a wheel assembly having a wheel configured to roll along the refractory material as the apparatus is moved within the structure by an operator. The wheel assembly may comprise at least two spaced apart wheels configured to simultaneously roll along the refractory material as the apparatus is moved within the structure In some embodiments, each engagement member may comprise a skid configured to slide along the refractory material as the apparatus is moved within the structure by an operator.

In some embodiments, each nozzle head of the nozzle assembly may be approximately equidistant from the axis of rotation In some embodiments, the rotation means may be any one or a combination of the following: an exchanger that is powered by pressurized liquid or gas; an electric motor; a pneumatic motor; and a hydraulic motor.

In some embodiments, each extension means may be any one or a combination of the following: a spring; a hydraulic extender; and a pneumatic extender.

In some aspects, the present invention further provides a method of removal of refractory material lining the inside surface of a cylindrical structure, the method comprising the steps of: providing an apparatus in accordance with any of the above described embodiments; placing the apparatus in the structure so that the axis of rotation of the nozzle assembly is approximately coincident with the central axis defined by the structure; applying fluid at a high pressure to the nozzle assembly through the conduit means whereby high pressure jets of the fluid are forced against the refractory through the nozzle heads; and moving the traveler over the refractory in order to cut the refractory with the high pressure jets.

In some embodiments, fluid is water at pressures between 20,000 p.s.i. and 40,000 p.s.i.

In some embodiments, the method may further include the step of providing an extension at a terminal end of the structure wherein the extension is adapted to permit the traveler to continue to move within the extension even after the traveler has been moved out of the structure so as to maintain an operative orientation of the nozzle assembly for a distance sufficient to enable the refractory material to be removed up to the terminal end of the structure.

BRIEF DESCRIPTION OF THE DRAWINGS

For a better understanding of the present invention and to show more clearly how it may be carried into effect, reference is made by way of example to the accompanying drawings in which.

DETAILED DESCRIPTION OF THE INVENTION

Figure 1:
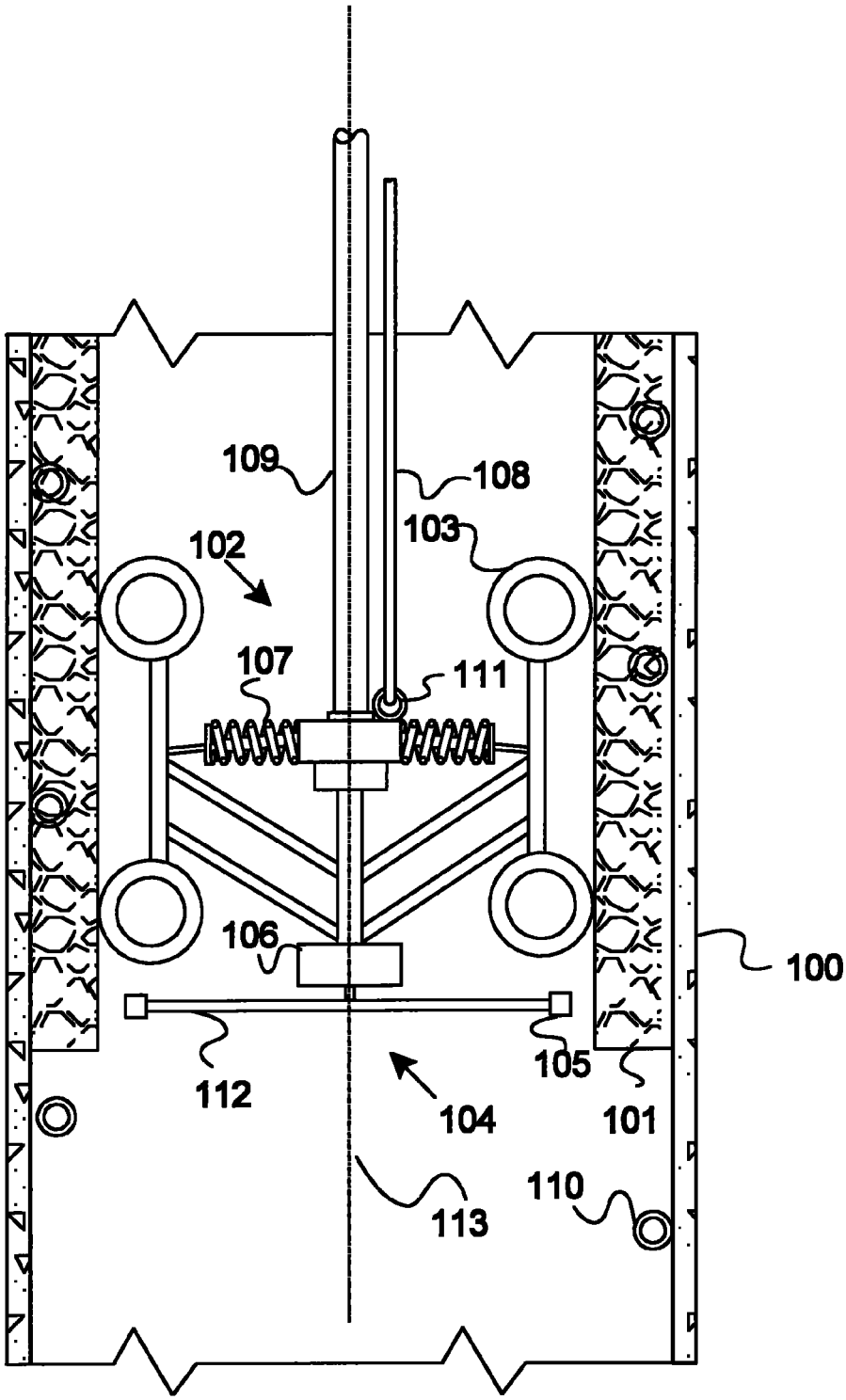
FIG. 1 is a cross-sectional view of an embodiment of an apparatus in accordance with the present invention within a cylindrical RLS in which the refractory has been partially removed.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
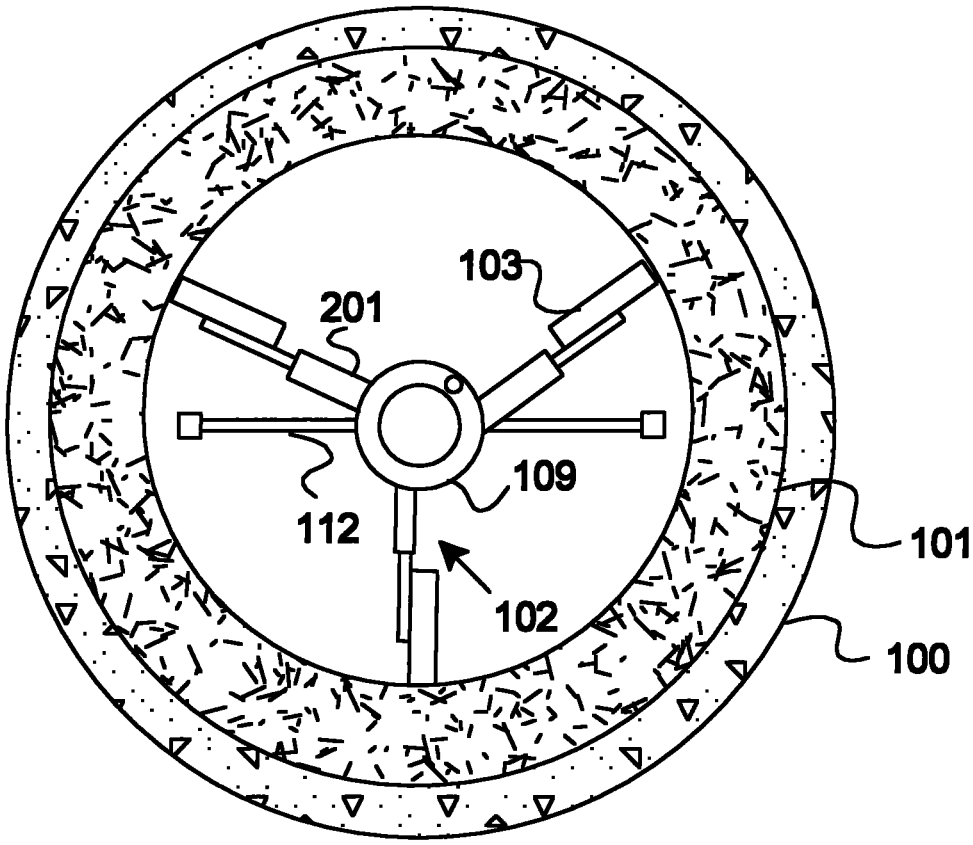
FIG. 2 is a top view looking down of the apparatus of FIG. 1 in the vertically oriented RLS, wherein the refractory and RLS appear as concentric rings about a central axis.

With reference to the figures, FIG. 1 is a cross-sectional view a cylindrical RLS 100, with the refractory 101 partially removed. FIG. 2 is a top view looking down into the vertically oriented RLS 100, wherein the refractory 101 and RLS 100 appear as concentric rings about a central axis 113, shown in FIG. 1. By way of example, the RLS may be a riser, although the scope of the invention goes well beyond risers to include any type or manner of RLS. As is common in the art, a plurality of anchors 110 extend from the side of the RLS in order to hold and stabilize the refractory.

The system of the invention includes a rotating nozzle assembly 104 that comprises one or more rigid nozzle lines 112 connected to nozzle heads 105. The nozzle assembly is caused to rotate about an axis of rotation by a nozzle rotation means 106. The axis may be approximately coincident or co-extensive with a central axis 113 of the RLS. The rotation means may be an exchanger that is powered by pressurized liquid or gas; it may be an electric motor, pneumatic motor, or hydraulic motor.

The nozzle assembly and rotation means are carried on a traveler 102. One function of the traveler is to allow the nozzle assembly to ride within the RLS along the central axis 113, and thereby keep the nozzle heads 105 properly spaced from the refractory 100 in order to deliver an optimum jet of fluid under sufficient pressure to cut the refractory. The fluid, which is normally water, is delivered to the nozzle assembly by a conduit means 109, which may be a pipe or a hose.

FIG. 2 shows how the traveler comprises a chassis or frame having engagement members such as wheels 103 attached thereto. In the embodiment shown, three sets of wheel assemblies are employed. The wheel assemblies are positioned at approximately 120° intervals about the inner circumference of the RLS 100. In this way, the center of the traveler, particularly the axis of rotation of the nozzle assembly 104, can be maintained approximately coincident with the RLS axis 113. The number of wheel assemblies can vary depending on the shape of the RLS so long as there are at least a sufficient number to keep the traveler, particularly the nozzle assembly 104, approximately centered in the RLS.

The wheel assemblies may comprise one or more wheels, chassis members, and an extension means, which forces the wheels against the refractory. In FIG. 1, spring 107 acts as the extension means by putting pressure against the wheels, forcing them against the refractory. Other devices for effectuating the extension means include hydraulic and pneumatic extenders or shock-absorber devices 201 such as shown in FIG. 2. Accordingly, the wheel assemblies together with the extension means provides an embodiment of a securing means on the traveler that secures the traveler within the structure in a manner that allows the traveler to be intentionally moved by an operator. In FIGS. 1 and 2, the wheels 103 of the traveler are pressed against the refractory, thereby keeping the traveler centered in the riser. Nozzle line 112 and nozzle head 105 express high pressure fluid supplied by means of conduit 109. An attachment means such as suspending cable 108 holds the traveler at the appropriate position within the RLS.

In a vertically oriented RLS, the traveler can be conveniently suspended in the RLS and moved up and down by means of an attachment means such as a suspension line 108 connected to a hoist (not shown). The suspension line is attached to an attachment member such as an eye 111 or other attachment point on the traveler.

The method of using the system to remove refractory from an RLS includes the steps of: 1) providing the system; 2) placing the system in the RLS so that the center of rotation of the nozzle assembly 104 is approximately coincident with the central axis 113; 3) applying fluid at a high pressure to the nozzle assembly through the conduit 109 whereby high pressure jets of the fluid are forced against the refractory 101 through the nozzles 105; and 4) moving the traveler 102 over the refractory in order to cut the refractory with the high pressure jets. The pressure of the fluid will vary according to the thickness and quality of the refractory. Generally, a pressure of between 20,000 p.s.i. and 40,000 p.s.i. is sufficient. In many situations in which the RLS is vertical it will be preferred to begin the process at the bottom of the RLS and move the traveler upwards. However, in some difficult cases it may be necessary to move the rotating nozzles up and down multiple times over a given length of refractory.

Figure 3:
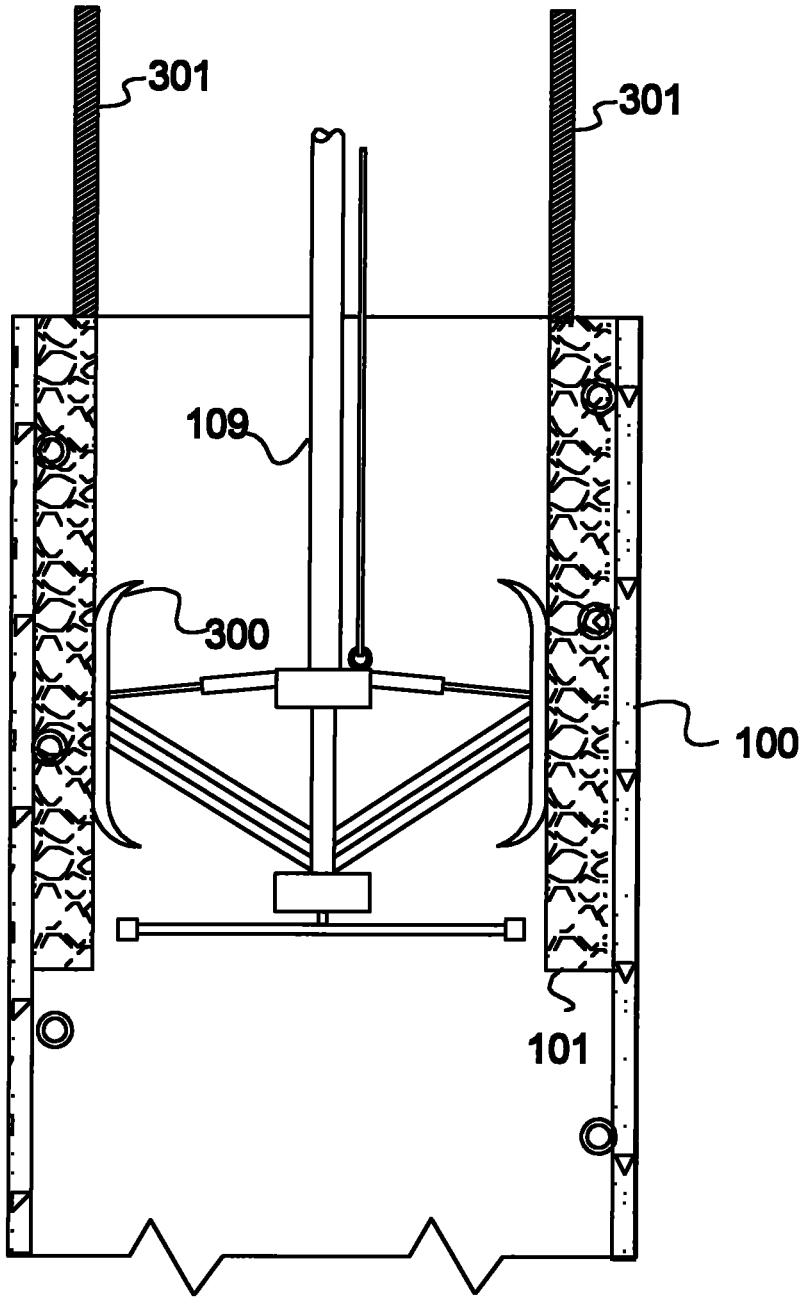
FIG. 3 is a cross-sectional view of another embodiment of an apparatus in accordance with the present invention within a cylindrical RLS in which the refractory has been partially removed.

FIG. 3 shows another embodiment of the apparatus in accordance with the present invention. FIG. 3 shows the top of the RLS 100 with the traveler 102 just about to complete the removal of the refractory. The traveler 102 in this embodiment has engagement members that comprise skids 300 instead of wheels. Accordingly, the skids together with the extension means provides another embodiment of a securing means on the traveler that secures the traveler within the structure in a manner that allows the traveler to be intentionally moved by an operator. The skids 300 have the advantage of reducing the number of moving parts of the invention. The traveler could employ a combination of skids and wheels.

Also shown in FIG. 3 are structure extensions 301. Such extensions are attached to the RLS and allow the traveler to maintain its orientation along axis 113 even after the traveler has been lifted outside the RLS. The skids or wheels merely travel along the structure extensions beyond the upper end of the RLS.

The invention has been described here with respect to a particular, preferred embodiment. Those of skill in the art will recognize that the scope of the invention obviously extends beyond this particular embodiment. For instance, various forms and designs of travelers and different types of nozzle rotators will, upon reading this disclosure, be obvious to those of skill in the art for accomplishing the disclosed functions. While the component elements of the invention well known, these elements perform in a different way to produce a different result than what has been described in, or is obvious from, the existing art. The novel and non-obvious arrangement of those elements results in the unexpected features, functions, uses, and advantages of the invention.

What is claimed is:

1. A method of removal of refractory material lining the inside of a cylindrical structure by hydro-demolition, said refractory having a surface facing and exposed to an inside cavity of said structure, the method comprising the steps of:

providing an apparatus comprising:

a traveler adapted to being received within the structure and to being moved continuously along the inside of the structure, the traveler including a securing assembly that secures the traveler within the structure in a manner that allows the traveler to be intentionally moved by an operator;

one or more engagement members extending from said traveler for contacting said surface to maintain a central axis of said traveler substantially coincident with a central axis of said structure during travel along the inside of said structure;

a rotatable nozzle assembly defining an axis of rotation and being connected to the traveler, the nozzle assembly comprising one or more nozzle lines each terminating in a nozzle head that rotates about the axis of rotation, the nozzle assembly being configured in a manner that each nozzle head is suitably spaced from the refractory to be able to deliver a jet of fluid under pressure to the refractory;

a nozzle rotation means for rotating the nozzle assembly; and a conduit means in fluid communication with the nozzle assembly suitable for delivering a flow of fluid to the nozzle assembly under high pressure to disintegrate said refractory material lining the structure;

placing the apparatus in the structure so that the axis of rotation of the nozzle assembly is approximately coincident with the central axis defined by the structure;

applying fluid at a high pressure to the nozzle assembly through the conduit means whereby high pressure jets of the fluid are forced against said facing surface of said refractory through the nozzle heads;

moving the traveler over the entirety of said facing surface of the refractory in order to disintegrate the entirety of said surface and said refractory with the high pressure jets; and providing an extension at a terminal end of the structure wherein the extension is adapted to permit the one or more engagement members to travel along said extension even after the traveler has been moved out of the structure, so as to maintain said central axis of said traveler substantially coincident with said central axis of said structure to enable the refractory material to be removed up to the terminal end of the structure.

* * * * *